US005435356A

United States Patent [19]

Rabinovich

[11] Patent Number: 5,435,356

[45] Date of Patent: Jul. 25, 1995

[54] VAPOR RECOVERY NOZZLE

[76] Inventor: Joshua E. Rabinovich, 15 Voss Ter., Newton, Mass. 02159

[21] Appl. No.: 261,035

[22] Filed: Jun. 14, 1994

Related U.S. Application Data

[62] Division of Ser. No. 72,007, Jun. 7, 1993, Pat. No. 5,341,855, which is a continuation-in-part of Ser. No. 893,335, Jun. 1, 1993, Pat. No. 5,297,594.

[51] Int. Cl.[6] ..... B65B 31/00

[52] U.S. Cl. ..... 141/59; 141/218; 141/226

[58] Field of Search ..... 141/206–211, 141/214, 215, 217, 218, 225, 226, 392, 59, 44–46

[56] References Cited

U.S. PATENT DOCUMENTS

| | | | |
|---|---|---|---|
| 3,016,928 | 1/1962 | Brandt | 141/45 |
| 3,208,486 | 9/1965 | Fromm | 141/217 X |
| 3,323,560 | 6/1967 | Ehlers . | |
| 3,451,444 | 6/1969 | Murray | 141/225 |
| 3,638,689 | 2/1972 | Eklund | 141/214 |
| 3,826,291 | 7/1974 | Steffens | 141/59 |
| 3,835,899 | 9/1974 | Holder, Jr. | 141/214 |
| 3,845,792 | 11/1974 | Johnson | 141/46 |
| 3,850,208 | 11/1974 | Hamilton | 141/59 |
| 3,929,175 | 12/1975 | Coone | 141/392 |
| 3,974,865 | 8/1976 | Fenton et al. | 141/392 X |
| 4,068,687 | 1/1978 | Long | 141/392 |
| 4,199,012 | 4/1980 | Lasater | 141/59 X |
| 4,202,385 | 5/1980 | Voelz et al. | 141/59 |
| 4,331,187 | 5/1982 | Trygg | 141/218 |
| 4,343,336 | 8/1982 | Trygg | 141/218 |
| 4,429,725 | 2/1984 | Walker et al. . | |
| 4,735,293 | 4/1988 | Ehlers | 141/218 |
| 4,796,678 | 1/1989 | Motohashi et al. | 141/206 |
| 5,035,271 | 7/1991 | Carmack et al. . | |
| 5,150,742 | 9/1992 | Motohashi et al. . | |
| 5,174,346 | 12/1992 | Healy . | |
| 5,217,051 | 6/1993 | Simpson et al. . | |
| 5,297,594 | 3/1994 | Rabinovich | 141/59 |
| 5,307,848 | 5/1994 | Murray | 141/44 |

FOREIGN PATENT DOCUMENTS

| | | | |
|---|---|---|---|
| 0155186 | 9/1985 | European Pat. Off. | 141/45 |
| 3916691 | 11/1990 | Germany | 141/59 |

*Primary Examiner*—J. Casimer Jacyna
*Assistant Examiner*—Steven O. Douglas
*Attorney, Agent, or Firm*—James Creighton Wray

[57] ABSTRACT

A vapor recovery nozzle has a dual passage hose connector, a fluid control body connected to the connector, a fluid turbine body connected to the fluid control body, and a fluid venturi body mounted within the fluid turbine body, a barrier flange and a vapor impeller housing surrounding a fluid and vapor conduit spout and connected to the barrier flange and fluid turbine body. A fluid turbine and a vapor impeller are mounted on opposite sides of the barrier flange on bearings which are supported on an axle extended from the venturi body. Magnetic couplings drive the vapor impeller with the fluid turbine. Fluid vapor is actively withdrawn from the tank and is moved under a positive discharge pressure through the vapor channel and in the nozzle guard, past a check valve in the vapor channel and through the vapor passage in the hose. Fluid is controlled by a poppet valve which is closed in the direction of fluid flow by a spring. An inner plunger opens a valve when the inner plunger is connected to an outer plunger by needle rollers. The outer plunger is moved by a cam connected to the fluid lever. Fluid flows inward through tangential openings in a turbine chamber, and then flows through a venturi and check valve. A radial opening near the check valve produces a reduced pressure, which is raised by vapor drawn through a sensor opening near a distal end of the nozzle. The opening is closed by liquid.

26 Claims, 8 Drawing Sheets

FIG. 8
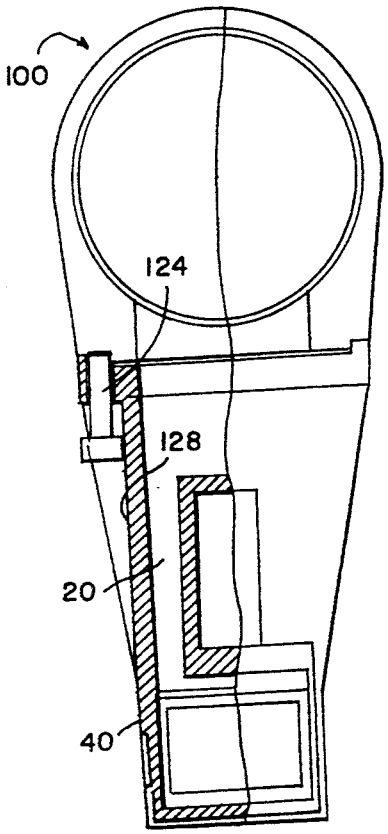
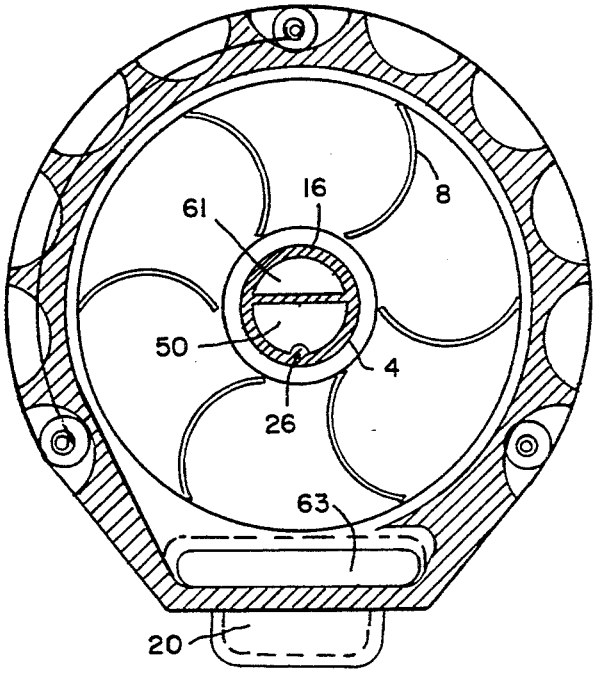
FIG. 2
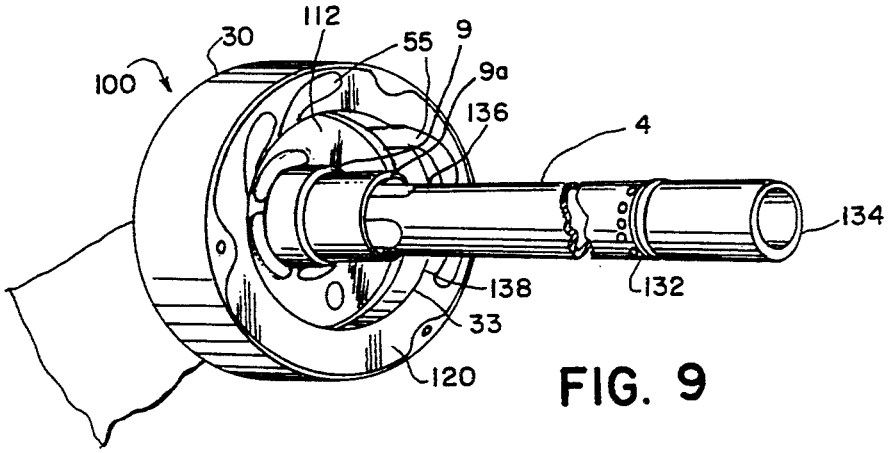
FIG. 9

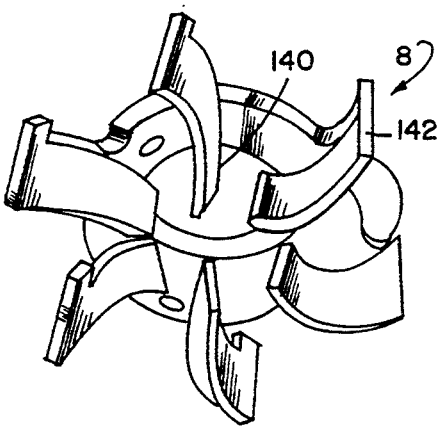
FIG. 10
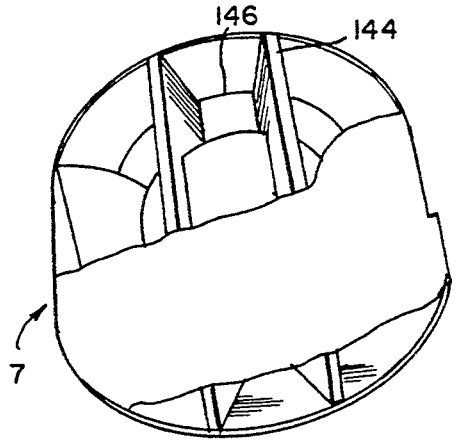
FIG. 11
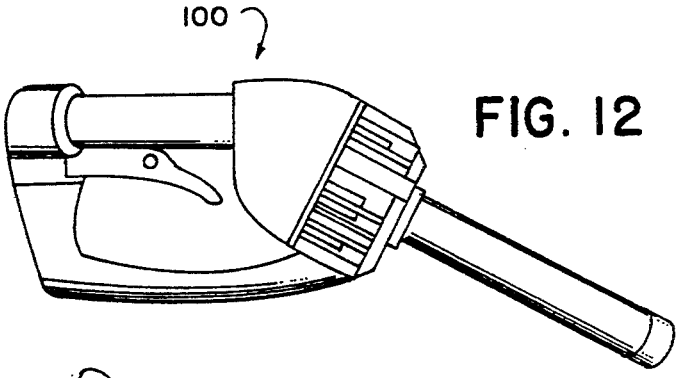
FIG. 12
FIG. 13
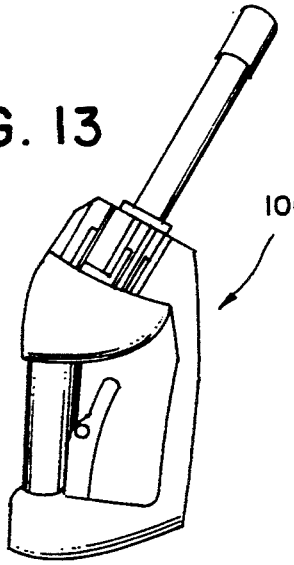
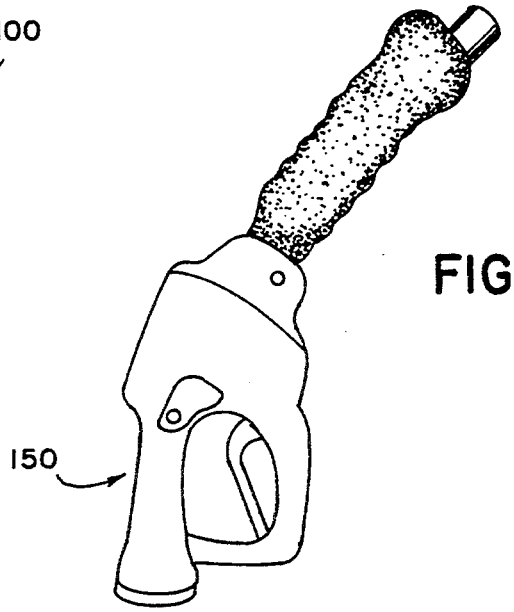
FIG. 14

VAPOR RECOVERY NOZZLE

This application is a division of application Ser. No. 08/072,007, filed Jun. 7, 1993 U.S. Pat. No. 5,341,855.

This is a continuation-in-part of application Ser. No. 07/893,335 filed Jun. 1, 1993 now U.S. Pat. No. 5,297,594.

BACKGROUND OF THE INVENTION

There are two major Stage 2 vapor recovery systems in use: the balanced system and the vacuum assist system.

The balanced system uses the positive pressure created in a gasoline tank during fueling, which forces the gasoline vapors from the tank through the vapor recovery nozzle and a special gasoline/vapor hose back into the service station storage tank.

The vacuum assist system, in addition to a vapor recovery nozzle and hose, requires a vacuum pump which provides a vacuum assist for transporting the vapors from the automobile tank back into the storage tank. Because of the additional equipment, the vacuum assist system is more costly to install and maintain. For that reason, the balanced system has been preferred by the industry.

The existing vapor recovery nozzles for either system are difficult to handle, difficult to insert and difficult to seal with automobile fill pipes. Both systems are prone to gasoline splash-back and spillage and are hated by both service station owners and motorists.

In addition, the rubber bellow/boot that is used to make a seal on the existing vapor recovery nozzles are prone to cuts. The cuts nullify the efficiency of the entire vapor recovery system. When detected by EPA inspectors, cuts in boots result in large fines to the service station owners.

One of the requirements for any type of vapor recovery system is that liquid must not be aspirated into the vapor return conduit from the vehicle tank or fill pipe or from other parts of the nozzle, otherwise customers would be charged for fluid which was aspirated back to the storage tank after having passed through the dispenser's meter.

To achieve the required efficiency of the vapor recovery system, the vacuum generated at the pump must be maintained at a particular level. If the vacuum is too high, fluid will be aspirated back into the vapor recovery line and the customer will be charged for fluid he has not received.

If the vacuum is not sufficient, or is too low, the required efficiency of the vapor recovery system will not be achieved, and an excessive amount of vapor will be released into the atmosphere.

In the vacuum assist vapor recovery systems currently in use, a centrifugal vacuum pump is positioned in the storage tank area. Vacuum is generated in the storage tank and must be transmitted through the piping and the entire length of the flexible hose that connects the dispenser with the vapor recovery nozzle.

This arrangement creates fluctuations of the vacuum level at the nozzle/filler neck connection due to variations in the number of dispensers used at the same time and changes in the hose restrictions as functions of vehicle-dispenser orientations.

Another arrangement described in U.S. Pat. No. 3,826,291 employs a positive displacement pump, such as a vane pump, at each dispenser. It must also maintain the sufficient vacuum through the entire length of the flexible hose to the nozzle. The initial high cost, as well as the inherent high wear and maintenance cost, make that solution an unattractive choice for service station owners.

A need exists for an improved system for vapor recovery in gasoline dispensing.

SUMMARY OF THE INVENTION

This invention provides a bellowless vapor recovery nozzle equipped with its own onboard low cost, low maintenance vapor recovery pump. The new nozzle allows the achievement of an optimal and repeatable vacuum level at the nozzle/filler neck interface, which significantly improves the effectiveness of the entire vapor recovery installation.

The new vapor recovery nozzle combines the advantages of low cost installation and maintenance of the "balanced" vapor recovery system with the ease of operation of the pre-vapor recovery bellowless nozzle.

The present invention provides a lightweight, easy to operate nozzle that eliminates the need for the rubber boot which is installed on most of the currently used vapor recovery nozzles.

The invention eliminates a need for expensive and costly to maintain positive displacement vapor pumps which are installed on dispensers.

The new nozzle of the invention improves stability of the vacuum level at the interface of the nozzle and the vehicle tank filler neck. That feature provides a more efficient vapor recovery system and reduces the possibility of the system getting into a mode of recirculation of fluid back into the storage tank.

A fluid driven centrifugal vapor pump is an integral part of the dispensing nozzle. The pump transfers the vapor through the flexible hose under positive pressure created by the pump. The vapor is aspirated from the vehicle's tank through a vapor passage of a constant restriction, connected to the suction side of the vapor pump. The constant restriction suction passage provides a desirable vacuum level at the filler pipe/nozzle interface and insures the optimal performance of the vapor recovery system.

A fundamental characteristic of centrifugal pumps is such that, at the given rotational speed, variations in the hose restriction on the pressure side of the pump will not change the vacuum level at the interface of the nozzle and the vehicle's filler neck. In addition, change in vapor passage restriction on the pressure side of the pump will change the vapor flow to a lesser degree than the same change in the hose restriction when a hose was on a suction side of a pump.

The present system provides the desired constant vacuum level at the nozzle/filler neck interface and improves the effectiveness and the efficiency of the vapor recovery system.

Thus the invention uses fundamental theoretical characteristics of centrifugal pumps to the best advantage.

All previous inventions, starting with U.S. Pat. No. 3,016,928 of R. J. Brandt and all following patents regarding vacuum assist pumps in vapor recovery systems, did not appreciate this issue. In all those patent, the pumps are on the dispenser side of the hose.

The integral nozzle centrifugal vapor pump and the conducting of vapor under positive pressure through the relatively long flexible hose is a major strength of the invention.

The invention provides a lightweight, easy to handle nozzle. The size and weight of prior art nozzles are governed by the requirements to accommodate large sizes of high level shut-off mechanisms.

The main valve and the high level shut-off latch mechanism in the nozzles currently in use must overcome high mechanical friction forces. The large friction forces require large actuation mechanisms, which in turn make the prior art nozzles bulky, heavy and difficult to handle.

The invention overcomes those problems by employing a low friction, high level liquid shut-off trigger mechanism. That allows for significant reduction in size and weight of the nozzle's housing allocated to the main valve and the high level shut-off trigger mechanism. That also allows the placement in the nozzle of an on-board fluid driven blower for vapor recovery in the nozzle itself, with further reduction in the overall size and weight of the nozzle. That increases significantly the user friendliness and reliability of the nozzle.

To achieve one of the main goals, a lightweight nozzle, with the handling and the ease of operation similar to the pre-vapor recovery nozzles, a new small size automatic shut-off trigger mechanism has been created.

The new in-line main valve and the small size automatic shut-off trigger mechanism significantly reduce the overall size and weight of the nozzle body and free the space necessary to accommodate a fluid-driven vapor recovery blower.

One approach to reducing the size of the automatic trigger mechanism was in departing from the high friction, mechanically operated latching mechanism and incorporating a low friction, hydraulically operated pilot valve, as described in the original application. A preferred embodiment of this application uses an improved mechanical latching mechanism.

Some reasons for the high friction and large size of the mechanisms currently in use are as follows:

Designs of competing U.S. nozzles employ a flat disc-type main valve, closing against a flat seat and located at a 90° turn of the fluid passage. With that type of arrangement, the initialization of the flow creates disc chatter and an unacceptable jerking operation. To eliminate that problem, a heavy load spring is applied to the disc. The heavy spring creates high friction forces in the automatic release latch mechanism, which in turn demands a large size housing for containing the spring and the sensing diaphragm which actuates the automatic release.

In the designs of the European nozzles, such as in U.S. Pat. No. 3,323,560 of K. Ehlers, the in-line tapered main poppet design reduces poppet chatter due to the fluid forces around the poppet. But the main spring must be relatively strong for the following reasons:

(a) The main poppet valve closes against the fluid flow.

(b) The main valve spring, while closing in the automatic mode, has to overpower the spring which returns the internal plunger and the lever assembly into its initial position.

That is a common arrangement in all European nozzle designs that are known to the inventor. The main spring has to have greater stiffness than would be warranted by the poppet chatter prevention requirement.

In the present invention, that streamlined poppet valve is created without the disadvantages described above. The main spring and the spring which returns the internal plunger and the lever are arranged in such a manner that the main spring does not have to overpower the return spring in the closing of the main poppet valve.

Thus, the main valve/latch mechanism allows for a main spring force which is smaller than the force in any prior art designs. The present reduction of force permits significant reduction in size of the actuation diaphragm and the housing containing it.

The reduction in the size of the main poppet/latch mechanism allows the placement of the latch mechanism in the nozzle handle, thus completely freeing the front part of the nozzle for the fluid driven turbine and the vapor blower.

A vapor recovery nozzle has a dual passage hose connector, a fluid control body connected to the connector, a fluid turbine body connected to the fluid control body, and a fluid venturi body mounted within the fluid turbine body, a barrier flange and a vapor impeller housing surrounding a fluid and vapor conduit spout and connected to the barrier flange and fluid turbine body. A fluid turbine and a vapor impeller are mounted on opposite sides of the barrier flange on bearings which are supported on an axle extended from the venturi body. Magnetic couplings drive the vapor impeller with the fluid turbine. Fluid vapor is actively withdrawn from the tank and is moved under a positive discharge pressure through the vapor channel and in the nozzle guard, past a check valve in the vapor channel and through the vapor passage in the hose. Fluid is controlled by a poppet valve which is closed in the direction of fluid flow by a spring. An inner plunger opens a valve when the inner plunger is connected to an outer plunger by needle rollers. The outer plunger is moved by a cam connected to the fluid lever. Fluid flows inward through tangential openings in a turbine chamber, and then flows through a venturi body and check valve. A radial opening between the check valve and venturi body produces a reduced pressure in the sensing liner and diaphragm chamber, which is kept in equilibrium by vapor drawn through a sensor opening near a distal end of the nozzle. When the sensor opening is closed by liquid, the pressure is further reduced in the sensing lines and in a diaphragm chamber, pulling the needle rollers out of their plunger connecting positions, disconnecting the plungers and allowing the valve spring to return the poppet to its closed position. The valve spring and a plunger spring provide sufficient force to hold a control lever tooth engaged with a fixed tooth. When the plungers are disengaged, the control lever tooth loses contact with the fixed tooth.

A preferred vapor recovery nozzle has a connector for connecting a two-chamber hose and a fluid inlet. A fluid inlet chamber is connected to the fluid inlet. A poppet valve in the fluid inlet chamber controls flow of fluid from the fluid inlet chamber. A fluid inlet channel leads from the valve. Tangential inlet ports lead from the fluid inlet channel into a fluid driven impeller chamber. A fluid delivery channel leads from the turbine chamber. A fluid check valve is connected to the fluid delivery channel, and a fluid conduit in a spout leads from the check valve for conducting fluid into a tank filler neck. A vapor recovery conduit is connected to the spout parallel to the fluid conduit. A vapor impeller chamber is connected to the vapor conduit. A vapor impeller rotates within the vapor impeller chamber. A fluid turbine rotates within the fluid turbine chamber. A rotation coupling between the fluid turbine and the vapor impeller causes the vapor impeller to rotate upon rotation of the fluid turbine. A vapor channel is connected to the vapor impeller chamber outlet, and a check valve is connected to the vapor channel. The vapor channel is connected to the connector for conducting vapor from the vapor channel into a vapor recovery passage in a hose.

A preferred nozzle has a fluid turbine body, with the turbine chamber forming an axial end of the turbine chamber body. A venturi body is mounted in a recess of the turbine chamber body. A fluid delivery channel and a check valve seat are mounted therein.

Preferably an axle extends axially from the venturi body for supporting the turbine and the vapor impeller. A turbine bearing is mounted on the axle for rotationally supporting the fluid turbine. A barrier flange closes the fluid turbine chamber and an O-ring seal seals the barrier flange and the axle.

A vapor impeller bearing is mounted on the axle for supporting the vapor impeller, and a housing surrounds the vapor impeller chamber. The housing has an axial end connected to the barrier flange and to the turbine body.

Preferably first magnet coupling is connected to the fluid turbine, and a second magnetic coupling is connected to the vapor impeller for rotating the vapor impeller with the fluid turbine.

A preferred fluid control has a poppet valve mounted on the end of a first plunger. A poppet valve spring is connected to the poppet valve for closing the poppet valve in the direction of fluid flow. A second plunger surrounds the first plunger. A releasable interconnection connects the first and second plungers. A fluid lever and a cam on the fluid lever are connected to the second plunger for moving the second plunger and moving the first plunger when the plungers are interconnected to open the poppet valve. A plunger return spring is connected to the second plunger for moving the second plunger to an inactive off position.

A preferred plunger interconnection has needle rollers movable between a slot in the first plunger for interconnecting the plungers, and a slot in the second plunger for disconnecting the plungers.

A cage is connected to the needle rollers for moving the rollers between the first and second positions. A diaphragm is connected to the cage and a diaphragm cavity is connected to the diaphragm. A sensor conduit is connected to the spout with a central opening near a distal end of the spout. A vacuum channel is connected to the check valve seat for reducing pressure in the vacuum channel upon flow of fluid past the check valve. The vacuum channel is connected to the sensor conduit for reducing the vacuum upon flow of vapor through the sensor channel, and is connected to the diaphragm chamber for reducing pressure in the diaphragm chamber when the sensor inlet is blocked by fluid, preventing reduction of vacuum by vapor circulating through the sensor conduit.

Preferably a control lever is connected to the fluid lever. The control lever has a tooth for cooperating with fixed teeth on the nozzle to hold the control lever, the first and second plungers and the poppet valve in open position while the plungers are interconnected and while the forces of the valve spring and plunger spring combine to press the control lever tooth into a fixed tooth, and for releasing the control lever and the operating lever upon loss of valve spring pressure upon the control lever tooth upon disconnection of the plungers.

The nozzle has a operating lever guard, and the vapor channel extends through the operating lever guard. A housing surrounds the vapor impeller chamber, and the housing is connected to the operating lever guard.

In one embodiment, vapor recovery conduit is mounted atop a fluid conduit, and the vapor recovery conduit and fluid conduit are substantially co-extensive in the spout.

In another embodiment, vapor recovery conduit surrounds the fluid conduit for contacting a neck restricter in a tank filler neck. An annular splash-back prevention maze is positioned in the vapor recovery conduit near a distal end thereof. A fluid drainage opening extends axially through a portion of the splash-back prevention maze.

These and further and other objects and features of the invention are apparent in the disclosure, which includes the above and ongoing written specification, with the claims and the drawings.

BRIEF DESCRIPTION OF THE DRAWINGS

FIG. 2 is a cross-sectional side elevational detail of the spout and vapor impeller in the nozzle taken along line B—B shown in FIG. 1.

FIG. 8 is a partial cross-sectional hose-end view of the nozzle.

FIG. 9 shows a partial assembly of the nozzle of FIGS. 1–5 having a modified coaxial spout showing a turbine chamber and tangential fluid ports.

FIG. 10 is a perspective view of the vapor impeller.

FIG. 11 is a perspective view of the fluid turbine.

FIG. 12 shows a perspective view of a preferred embodiment of the nozzle shown in FIGS. 1–5.

FIGS. 13 and 14 are perspective views comparing the new nozzle and a standard bellows-type vapor recovery nozzle.

DETAILED DESCRIPTION OF THE DRAWINGS

Figure 1:
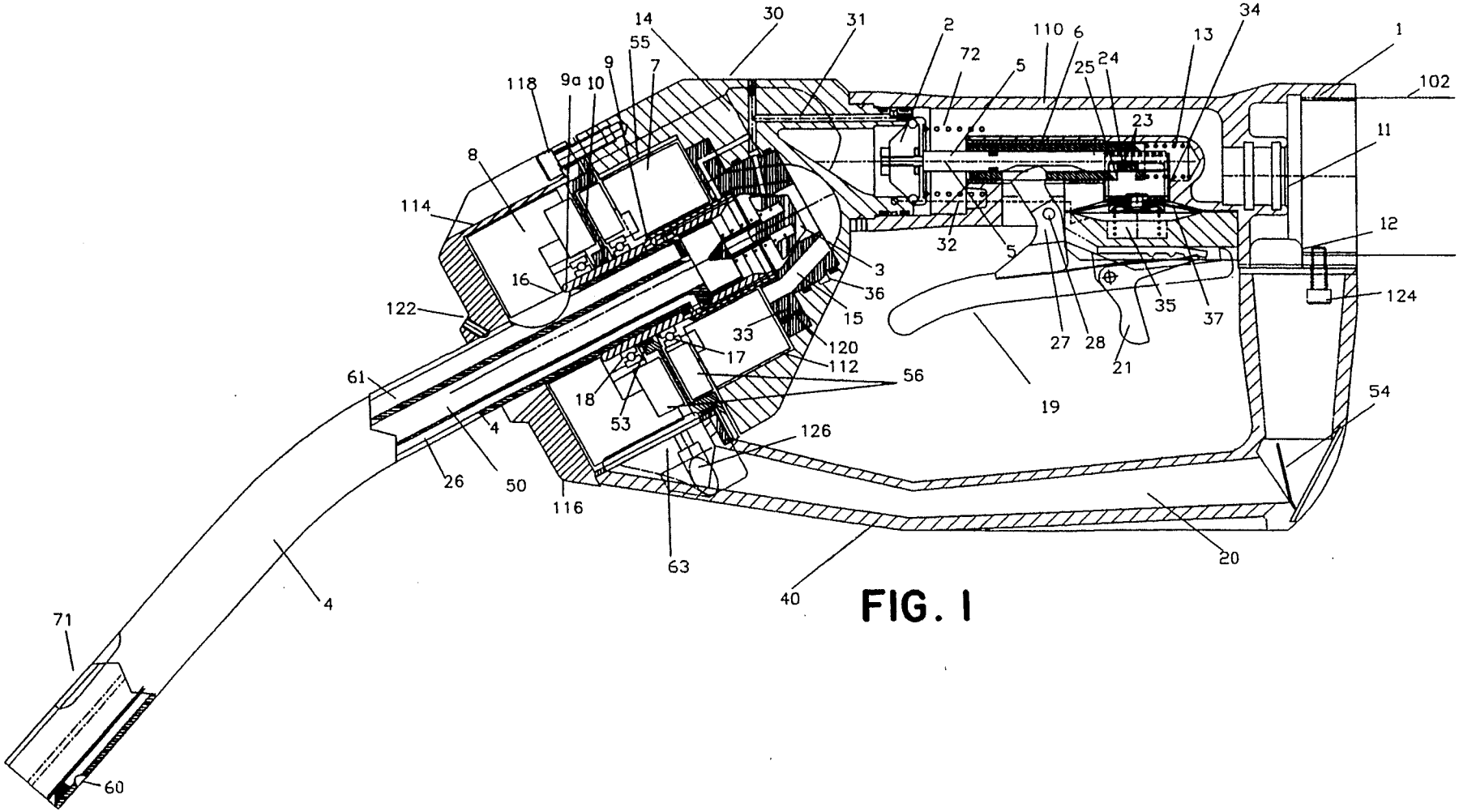
FIG. 1 is a cross-sectional side elevation of a vapor recovery automatic shut-off fluid dispensing nozzle.

Referring to the drawings, the major elements of the dispensing nozzle 100 are the nozzle body 1, a spout 4, a fluid driven turbine impeller 7, and a vapor pump impeller 8 which is installed on the extension 9*a* of the turbine shaft 9. The nozzle's main liquid flow control poppet valve 2 is actuated by the poppet plunger 5, coaxially but not rotationally movable inside of the outer plunger 6.

The movement of the outer plunger 6 can be transmitted to the poppet plunger 5 when the needle rollers 23 are located in the coinciding slots 24 and 25 of the plungers 5 and 6 respectively. The outer plunger 6 is moved by the cam 27 attached to the operating lever 19, which rotates around pin 28. The control lever 21 holds the position of the operating lever 19 and thus the opening of the main poppet valve 2 in several fluid rate positions.

The opening and closing of the main poppet valve 2 is thus regulated by the position of operating lever 19.

Gasoline is delivered through a coaxial hose 102 into the port 11, and passes around the main poppet 2 into the cavity 14 and through several jet nozzles 55 onto turbine impeller 7, and passes through cavities 15 of the venturi body 33 and the opening between the check valve 3 and venturi body 33, and out of the nozzle through the fuel conduit 50 in the spout 4. The spout 4 is divided into two conduits: the fuel conduit 50 for delivering the fluid, and the vapor conduit 61 for removing the vapor from the vehicle tank.

The turbine impeller 7 and the vapor pump impeller 8 are supported on the hollow shafts or axles 9 and 9*a* through the bearings 17 and 18. The hollow shaft 9 is permanently attached to the venturi body 33. Venturi body 33 is bolted to the turbine body 30.

The turbine impeller 7 is placed inside a cavity in the end of the turbine body 30. The turbine body has a fluid channel 14 which incorporates several jets directing a tangential fluid flow toward the impeller 7.

Magnets 56 installed on the turbine impeller 7 are positioned in proximity to magnets 56 on the blower 8 in the vapor blower chamber. These magnets transmit the torque developed in the turbine 7 to the vapor blower impeller 8.

The turbine chamber is separated from the vapor blower chamber with a thin flange 10 made of nonmagnetic material. Flange 10 holds an O-ring seal 53 on shaft 9.

When the front of handle 19 is raised, plunger 6 moves plunger 5 and poppet valve 2 and the fluid flows through the chamber 11, around the main poppet 2 into the cavity 14 and through the jet nozzles 55 onto the turbine 7. The turbine impeller 7 is rotated by the force of the fluid passing through the nozzles 55 and in turn rotates the vapor pump or impeller 8. The partial vacuum generated at the inner diameter area of the pump vanes of the vapor pump impeller 8 delivers the vapor from the vehicle tank, through the spout intake 71, vapor conduit 61 and upper spout intake 16 into the pump's delivery chamber 63 connected with the impeller's positive pressure outer diameter.

The vapor of this positive pressure flows through the vapor conduit 20 of the guard 40, check valve 54, chamber 12 and out through the coaxial hose 102, and is delivered back into the storage tank. The check valve 54 closes the vapor passage from the storage tank when the fluid is not dispensed.

The fluid passing between the check valve 3 and the venturi body 33 generates partial vacuum in the chamber 36 and through the channels 31 and 32, and is connected with the chamber 35 which is below the sensing diaphragm 37. The chamber 36 is also connected with the sensing line 26, which ends with the opening 60 at the end of the spout 4. Sensing line 26 reduces vacuum in chamber 36 by allowing fumes and air to pass through line 26 into chamber 36 until inlet 60 is blocked by fluid.

When the lever 19 is raised and the fluid level in the vehicle tank reaches the level of the opening 60, vapor no longer flows through line 26. The partial vacuum is created in the sensing lines 26, 31 and 32 and chambers 36 and 35. The vacuum in the diaphragm chamber 35 rises to the level sufficient for a change in the balance of forces that hold the roller cage 34 and the needle rollers 23 in the slot 24 of the plunger 5. With the needle rollers 23 pulled out of the slot 24 in the poppet plunger 5, the poppet plunger 5 with the poppet valve 2 is released from the bias of the outer plunger 6, and the fluid flow is shut off by spring 72, and by the fluid pressure, irrespective of the position of lever 19. The release of plunger 5 reduces pressure on plunger 6, dropping the control lever 21, or releasing the resistance fluid on the lever 19, when the latter is hand-held.

When the control lever is in the up position with its tooth engaging the fixed teeth, the force of spring 72 acting through plunger 5, needles 23 and plunger 6 holds the tooth-to-tooth gripping. When needles 24 drop and disconnect plungers 5 and 6, the weaker force of spring 13 does not hold the tooth to tooth contact. Control lever 21 drops, and spring 13 returns plunger 6, cam 27 and lever 19 to the off position.

When the lever 19 is released, the outer plunger 6 is moved by the return spring 13 into its initial position and resets the needle rollers 23 into the slot 24 of the poppet plunger 5.

Figure 5:
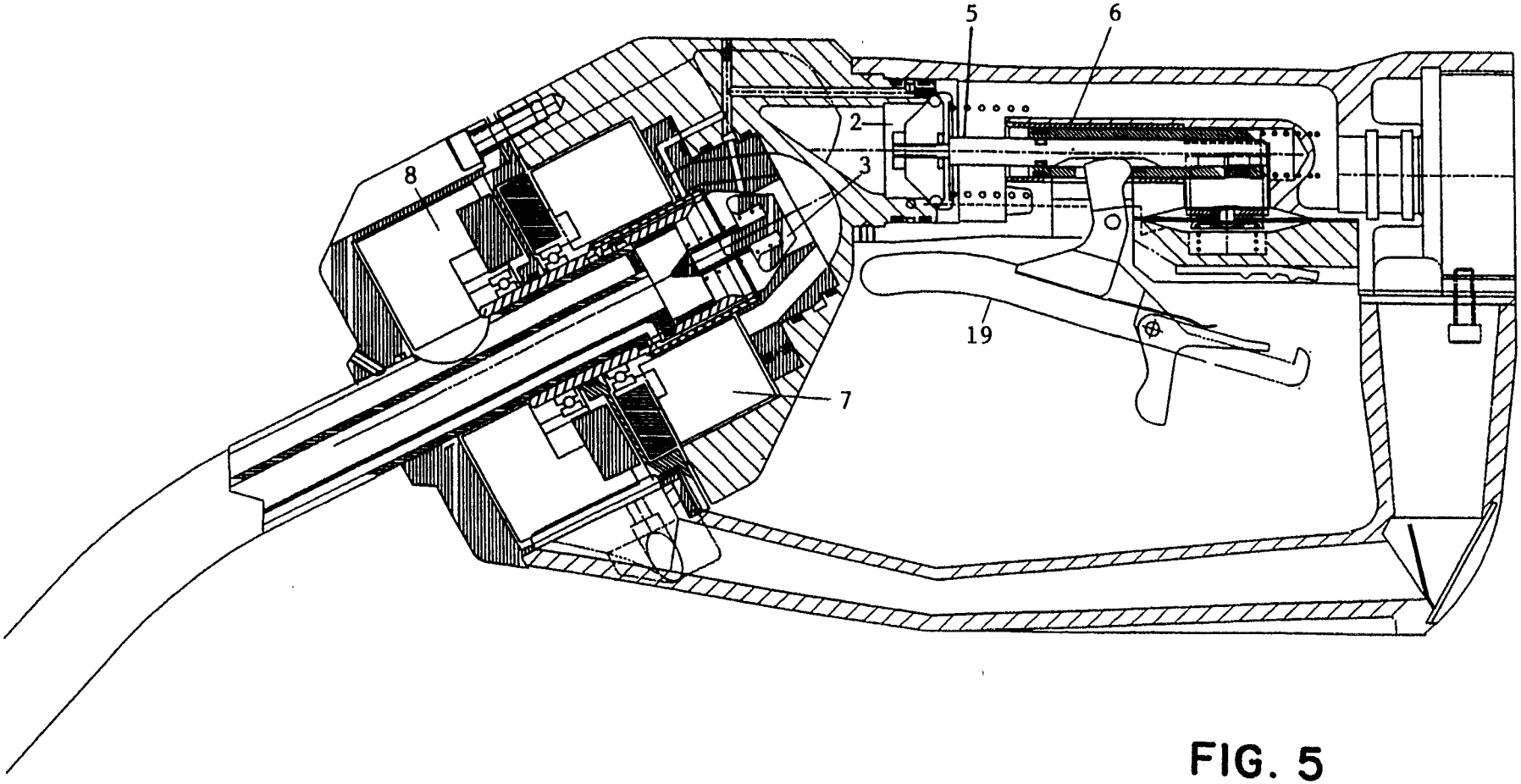
FIG. 5 is a detail of the nozzle in an automatic shut-off mode.
Figure 6:
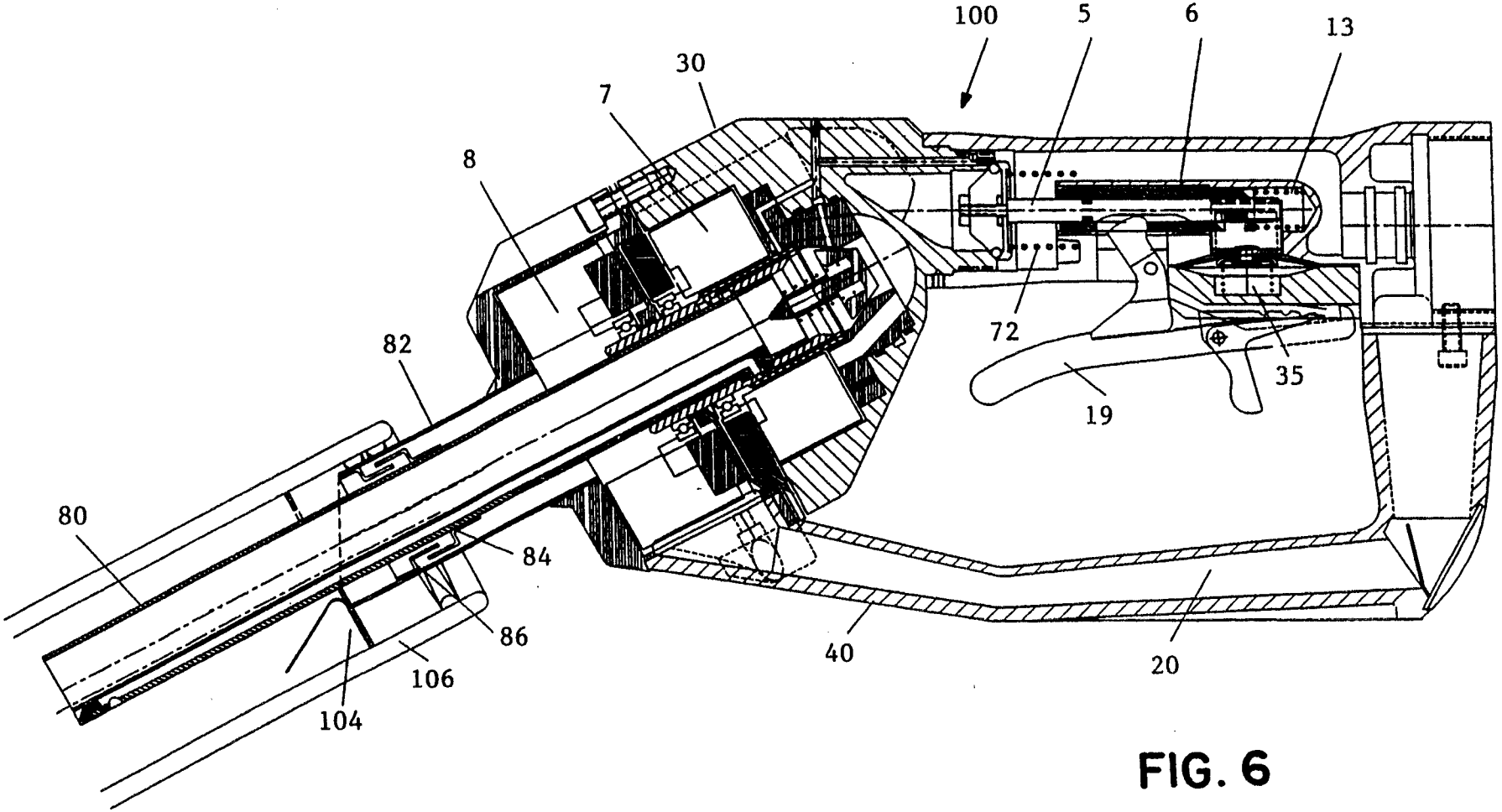
FIG. 6 is a cross-sectional detail of a modified large volume flow nozzle with a fluid splash-back protector on the spout.
Figure 7:
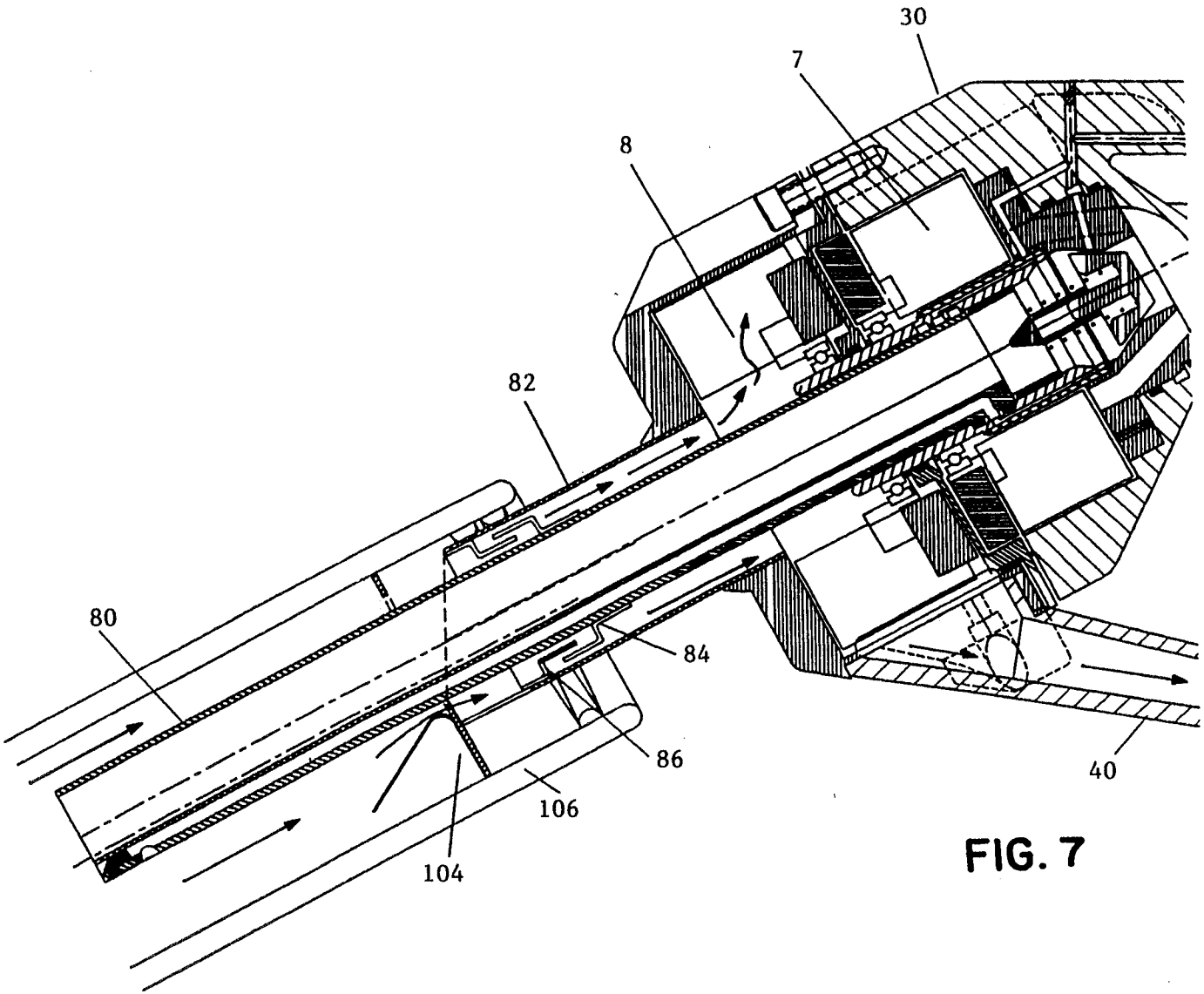
FIG. 7 is an enlarged cross-sectional detail of the nozzle shown in FIG. 6.

In the high flow nozzle as shown in FIGS. 6 and 7, similar parts have similar numbers. Large spout 80 extends through the neck restricter 104 on vehicle tank filler neck 106. Spout 80 is surrounded by tube 82 with a splash-back preventer 84 which allows vapor to follow a serpentine course but which traps and returns fluid splashes through fluid drainage opening 86. Splash-back preventer 84 is in the form of an annular maze through which vapor readily passes but through which fluid may not pass by kinetic energy caused by splashes. The working parts of the high flow nozzle are identical to the nozzle shown in FIGS. 1–5.

Figure 3:
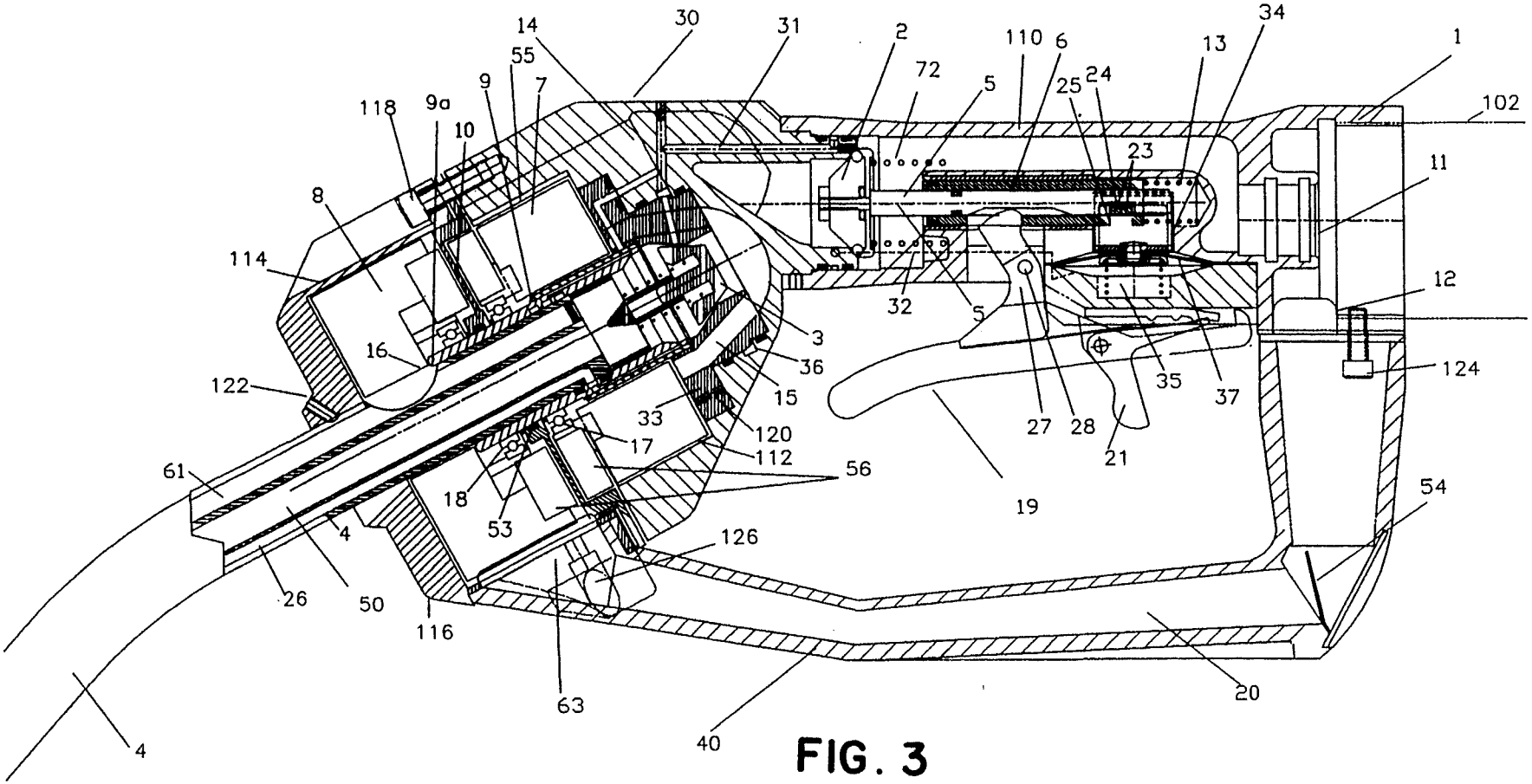
FIG. 3 is an enlarged cross-sectional side elevational detail of the nozzle shown in FIGS. 1 and 2 in an at rest mode.
Figure 4:
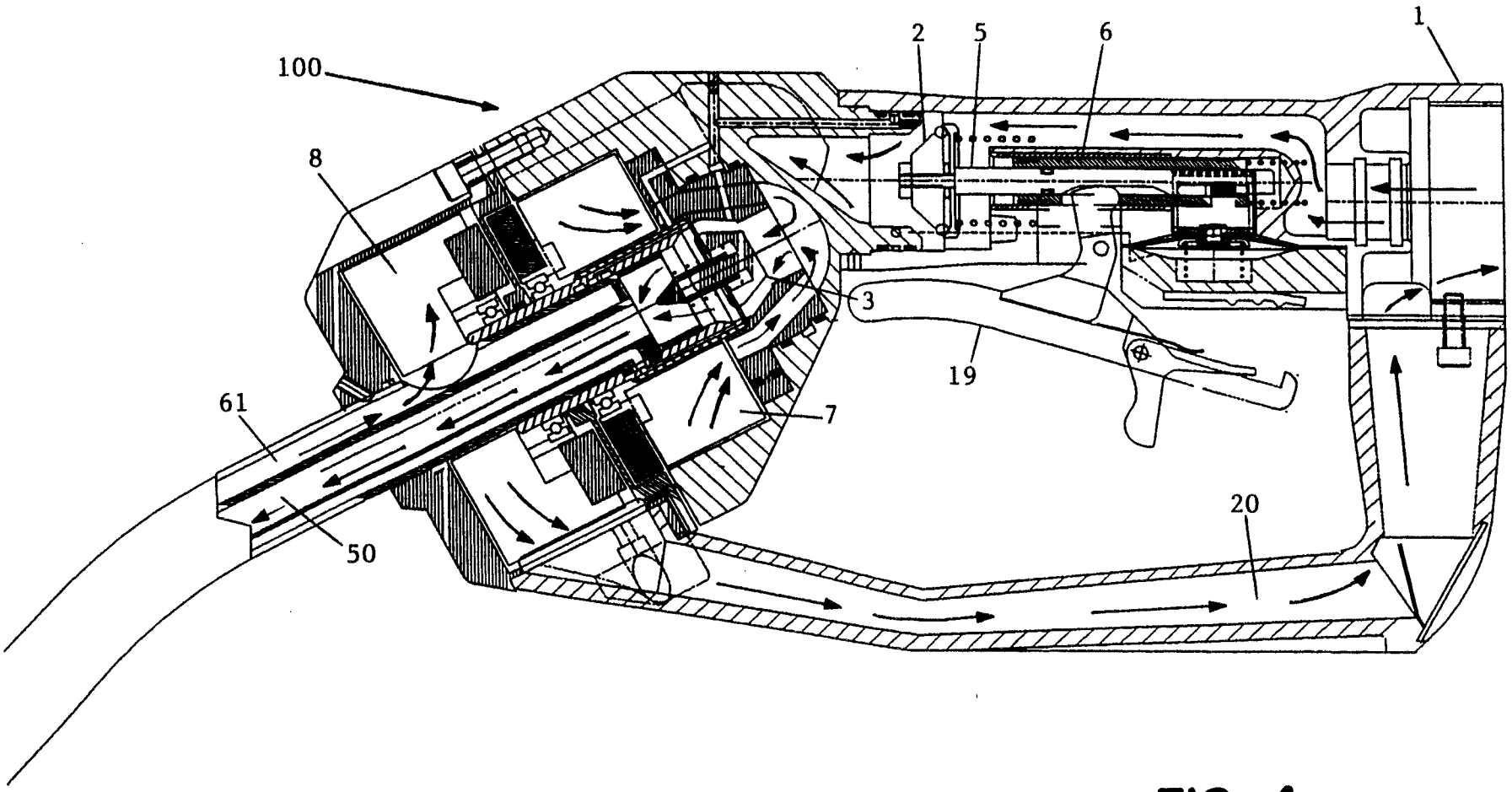
FIG. 4 is a detail of the nozzle shown in FIGS. 1–3 in an open mode.

As shown in FIGS. 3, 4 and 5, the nozzle 100 has several main sections. Fluid control section 110 is connected to the inlet 11. Turbine section 30 is connected to the fluid control section. Venturi section 33 is connected to the turbine section. The turbine section has the turbine chamber 112. Flange 10 encloses the turbine chamber, and vapor impeller chamber 114 in the vapor impeller housing 116. The centrifugal pump or blower vapor impeller housing 116 is bolted 118 to turbine section 30. The venturi section 33 is bolted 120 to the turbine section 30, and the venturi section supports the axles 9 and 9*a* and the spout 4. The lightweight plastic vapor impeller housing 116 is connected to the spout with set screws 122. Bolts 124 clamp the guard 40 to the hose fitting and to the nozzle. Bolts in receivers 126 secure the front of guard 40 to the impeller housing 116.

Guard 40 is divided 128 at the rear of the nozzle 100, as shown in FIG. 8, so that the vapor channel is divided into two sections. Access for assembly of the check valve is provided through plate 130.

FIG. 9 shows the tangential ports 55 into the turbine chamber 112 and shows the mounting screws 120 which bolt the venturi body 33 to the turbine section 30. The axles 9 and 9A and spout 4 are supported by the venturi section. Openings 132 near the distal end 134 of spout 4 admit vapor. Large openings 136 at the proximal end 138 of the spout form the intake 140 for the vapor impeller 8.

FIG. 10 shows the centrifugal pump vapor impeller 8 with the curved blades 142, which take vapor from the low pressure intake and import kinetic energy and increase the pressure of the vapor at circumferential outlet 63, as shown in FIG. 1.

FIG. 11 shows the fluid turbine with tips 141, against which fluid flows from tangential ports 55, turning the turbine and releasing fluid axially through opening 146 into channels of the venturi 33.

The preferred nozzle 100 is shown in FIG. 12.

FIGS. 13 and 14 compare the new nozzle 100 and a bellows-type passive vapor recovery nozzle 150.

The nozzle of the present invention is useful with all fluids and vapors, and is particularly useful with fuel or chemical transfers between larger and smaller tanks. The system of the present invention is particularly useful with transfer of fluids between a source and a tank which are at or near atmospheric pressure and from which the release of vapors to the atmosphere would be undesirable.

The nozzle and system of the present invention are particularly useful in dispensing fuel from a storage tank into a vehicle and tank.

The use of a centrifugal pump of the present invention, and the placement of the centrifugal vapor pump near the tank being filled, are particularly useful for improved efficiency in transferring vapor under reduced or subatmospheric pressure through a relatively short structure of fixed configuration, and then transferring the vapor under slightly increased pressure or above atmospheric pressure for a longer distance over a flexible hose of varied or variable configuration.

While the invention has been described with reference to specific embodiments, modifications and variations of the invention may be constructed without departing from the scope of the invention, which is defined in the following claims.

I claim:

1. A nozzle apparatus comprises a connector for connecting to a hose, a fluid control valve body connected to the connector, a fluid inlet in the fluid control valve body, a fluid inlet chamber connected to the fluid inlet, a fluid control valve in the fluid inlet chamber for controlling flow of fluid from the fluid inlet chamber, a fluid inlet channel leading from the valve, wherein the fluid control valve comprises a first plunger, a valve disc mounted on the end of the first plunger, a valve disc spring connected between the fluid control valve body and the valve disc for closing the valve disc in the direction of fluid flow, a second plunger surrounding the first plunger, a releasable interconnection connecting the first and second plunger, a fluid lever and a cam on the fluid lever connected to the second plunger for moving the second plunger and moving the first plunger when the plungers are interconnected to open the valve disc.

2. The apparatus of claim 1, further comprising a plunger return spring connected between the fluid control valve body and the second plunger for moving the second plunger to an inactive position, and wherein the plunger return spring is not overpowered by the valve disc spring during times of automatic shut-off, thus minimizing required size and force parameters of the valve disc spring.

3. The apparatus of claim 2, wherein the interconnection comprises needle rollers movable between a first slot in the first plunger for interconnecting the plungers, and a second slot in the second plunger for disconnecting the plungers.

4. The apparatus of claim 3, further comprising a cage connected to the needle rollers for moving the rollers between first and second slots, a diaphragm connected to the cage and a diaphragm cavity connected to the diaphragm, and further comprising a sensor conduit connected to the spout and having a sensor opening near a distal end of the spout, a vacuum channel connected to the check valve seat for reducing pressure in the vacuum channel upon flow of fluid past the check valve seat, the vacuum channel connected to the sensor conduit for reducing partial vacuum in the vacuum channel upon flow of vapor through the sensor channel, and the vacuum channel connected to the diaphragm chamber for reducing pressure in the diaphragm chamber when the sensor opening is blocked by fluid, preventing reduction of the partial vacuum by preventing circulation of vapor through the sensor conduit and thereby reducing pressure in the diaphragm chamber.

5. The apparatus of claim 4, wherein the interconnection slots of the first and second plunger are positioned at a far end from the valve disc of the first plunger, the slots, the rollers, the cage and the diaphragm being located in the part of the nozzle away from a gripping portion of the fluid lever and in an area of fourth and fifth fingers of a hand used for the actuation of the control lever.

6. The apparatus of claim 3, further comprising a control lever connected to the fluid lever, the control lever having a tooth for cooperating with fixed teeth on the nozzle to hold the control lever, the first and second plungers and the poppet valve in open position while the plungers are interconnected and while the force of the valve spring and plunger spring combine to press the control lever tooth into a fixed tooth, and for releasing the control lever and the operating lever upon loss of valve spring pressure upon the control lever tooth upon disconnection of the plungers.

7. The apparatus of claim 3, wherein friction forces between the needle rollers and the slots of the first and the second plungers govern the size of the sensing element and result from force exerted by the valve disc spring only, the second plunger return spring not contributing to friction forces between the needle rollers and the slots of the first and the second plungers.

8. The apparatus of claim 7, wherein the handle is a liquid-conducting body, and further comprising a primary shut-off sensing element installed in a back portion of the body adjacent to a hose connection for allowing a front portion of the handle to have a sufficiently small cross-section for a person to grip the handle and the fuel control lever for initiating and controlling operation of the nozzle.

9. The apparatus of claim 1, further comprising tangential inlet ports leading from the fluid inlet channel, a fluid driven turbine chamber connected to the ports, a fluid delivery channel leading from the turbine chamber, a fluid check valve connected to the fluid delivery channel, a spout, a fluid conduit in the spout leading from the check valve for conducting fluid into a tank filler neck, a vapor recovery conduit connected to the spout parallel to the fluid conduit, a vapor impeller chamber connected to the vapor conduit, a vapor impeller mounted for rotating within the vapor impeller chamber, a fluid turbine rotating within the fluid turbine chamber, and a rotation coupling connected between the fluid turbine and the vapor impeller for causing the vapor impeller to rotate upon rotation of the fluid turbine, a vapor outlet connected to the vapor impeller chamber, a vapor channel connected to the vapor outlet, a check valve connected to the vapor channel, the vapor channel connected to the connector for conducting vapor from the vapor channel into a vapor recovery passage in a hose.

10. The apparatus of claim 9, wherein the nozzle has a fluid turbine body with the turbine chamber forming an axial end of the turbine chamber body, and further comprising a venturi body mounted in a recess in the turbine body, a fluid delivery channel and a check valve seat mounted in the venturi body, an axle extending axially from the venturi body for supporting the turbine and the vapor impeller, a turbine bearing mounted on the axle for rotationally supporting the fluid turbine, a barrier flange closing the fluid turbine chamber and an O-ring seal sealing the barrier flange and the axle, a vapor impeller bearing mounted on the axle for supporting the vapor impeller and a housing surrounding the vapor impeller chamber, the housing having an axial end connected to the barrier flange and to the turbine body for enclosing the vapor impeller chamber, and wherein the coupling comprises a first magnetic coupling connected to the fluid turbine and a second magnetic coupling connected to the vapor impeller for rotating the vapor impeller with the fluid turbine.

11. The apparatus of claim 1, further comprising a guide for guiding the first and second plunger in axial directions, and a key in the guide and coinciding longitudinal slots in the first and second plungers for preventing rotational movement of the second plunger and the first plunger by the key in the guide in the coinciding slots of the first and-second plunger.

12. The apparatus of claim 1, further comprising a nozzle handle and a hand grip, and wherein the valve disc and first and second plungers and their interconnection means are incorporated in the nozzle handle and are contained in a space of the hand grip for allowing convenient nozzle operation by providing an ergonomically correct arrangement to accommodate the human hand.

13. The apparatus of claim 1, wherein the valve disc is mounted at the first plunger and positioned in substantially a same transverse cross-section of a gripping portion of the nozzle apparatus, the fluid lever for providing an ergonomically advantageous gripping by the thumb, index and third finger necessary for initialization and control of the fluid lever and thus fluid flow.

14. The apparatus of claim 1, wherein the fluid lever and the cam on the fluid lever are linked with the second plunger for moving the second plunger in an axial direction and providing a guide for the first and second plunger in axial directions and preventing the rotational movement of the second plunger and the first plunger by serving as a key guide in coinciding longitudinal slots of the first and second plunger.

15. A fuel control nozzle apparatus comprises a connector for connecting a hose, a fluid inlet, a fluid control valve body, a fluid inlet chamber in the valve body and connected to the fluid inlet, a fluid control valve in the fluid inlet chamber for controlling flow of fluid from the fluid inlet chamber, a fluid inlet channel leading from the valve, wherein the fluid control valve comprises a first plunger, a valve disc mounted on the end of the first plunger, a valve disc spring connected between the fluid control valve body and the valve disc for closing the valve disc in the direction of fluid flow, a second plunger surrounding the first plunger, a releasable interconnection connecting the first and second plunger, a fluid lever and a cam on the fluid lever connected to the second plunger for moving the second plunger and moving the first plunger when the plungers are interconnected to open the valve disc.

16. A vapor recovery nozzle apparatus comprises a connector for connecting a two-passage hose, a fluid inlet connected to the hose, a fluid valve body connected to the fluid inlet, a fluid inlet chamber in the fluid valve body, a fluid control valve in the fluid inlet chamber for controlling flow of fluid from the fluid inlet chamber, a fluid inlet channel leading from the fluid control valve, wherein the fluid control valve comprises a first plunger, a valve disc mounted on the end of the first plunger, a valve disc spring connected between the fluid valve body and the valve disc for closing the valve disc in the direction of fluid flow, a second plunger surrounding the first plunger, a releasable interconnection connecting the first and second plunger, a fluid lever and a cam on the fluid lever connected to the second plunger for moving the second plunger and moving the first plunger when the plungers are interconnected to open the valve disc.

17. The apparatus of claim 16, further comprising a plunger return spring connected between the fluid valve body and the second plunger for moving the second plunger to an inactive position.

18. The apparatus of claim 17, wherein the interconnection comprises needle rollers movable between a first slot in the first plunger for interconnecting the plungers, and a second slot in the second plunger for disconnecting the plungers.

19. The apparatus of claim 18, further comprising a cage connected to the needle rollers for moving the rollers between first and second slots, a diaphragm connected to the cage and a diaphragm cavity connected to the diaphragm, and further comprising a sensor conduit connected to the spout and having a sensor opening near a distal end of the spout, a vacuum channel connected to the check valve seat for reducing pressure in the vacuum channel upon flow of fluid past the check valve seat, the vacuum channel connected to the sensor conduit for reducing partial vacuum in the vacuum channel upon flow of vapor through the sensor channel, and the vacuum channel connected to the diaphragm chamber for reducing pressure in the diaphragm chamber when the sensor opening is blocked by fluid, causing increase of the partial vacuum by preventing circulation of vapor through the sensor conduit and thereby reducing pressure in the diaphragm chamber.

20. The apparatus of claim 19, wherein the interconnection slots of the first and second plunger are positioned at a far end from the valve disc of the first plunger, the slots, the rollers, the cage and the diaphragm being located in the part of the nozzle away from a gripping portion of the fluid lever and in an area of fourth and fifth fingers of a hand used for the actuation of the control lever.

21. The apparatus of claim 18, wherein friction forces between the needle rollers and the slots of the first and the second plungers govern the size of the sensing element and result from force exerted by the valve disc spring only, the second plunger return spring not contributing to friction forces between the needle rollers and the slots of the first and the second plungers.

22. The apparatus of claim 21, wherein the handle is a liquid-conducting body, and further comprising a primary shut-off sensing element installed in a back portion of the body adjacent to a hose connection for allowing a front portion of the handle to have a sufficiently small cross-section for a person to grip the handle and the fuel control lever for initiating and controlling operation of the nozzle.

23. The apparatus of claim 16, further comprising a guide for guiding the first and second plunger in axial directions, and a key in the guide and coinciding longitudinal slots in the first and second plungers for preventing rotational movement of the second plunger and the first plunger by the key in the guide in the coinciding slots of the first and second plunger.

24. The apparatus of claim 16, further comprising a nozzle handle and a hand grip, and wherein the valve disc and first and second plungers and their interconnection means are incorporated in the nozzle handle and are contained in a space of the hand grip for allowing convenient nozzle operation by providing an ergonomically correct arrangement to accommodate a human hand.

25. The apparatus of claim 16, wherein the valve disc is mounted at the first plunger and positioned in substantially a same transverse cross-section of a gripping portion of the nozzle apparatus, the fluid lever for providing an ergonomically advantageous gripping by the thumb, index and third finger necessary for initialization and control of the fluid lever and thus fluid flow.

26. The apparatus of claim 16, wherein the fluid lever and the cam on the fluid lever are linked with the second plunger for moving the second plunger in an axial direction and providing a guide for the first and second plunger in axial directions and preventing the rotational movement of the second plunger and the first plunger by serving as a key guide in coinciding slots of the first and second plunger.

* * * * *